US010436420B2

(12) United States Patent
Xu et al.

(10) Patent No.: US 10,436,420 B2
(45) Date of Patent: Oct. 8, 2019

(54) ZOOM LED LAMP WITH SLIDABLE LENS

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Bozhang Xu, Zhejiang (CN); Haitao Wu, Zhejiang (CN); Guancong Shan, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/971,728

(22) Filed: May 4, 2018

(65) Prior Publication Data

US 2019/0093861 A1 Mar. 28, 2019

(30) Foreign Application Priority Data

Sep. 28, 2017 (CN) ..... 2017 1 0897312

(51) Int. Cl.
*F21V 14/06* (2006.01)
*F21V 5/04* (2006.01)
(Continued)

(52) U.S. Cl.
CPC ..... *F21V 14/06* (2013.01); *F21V 5/048* (2013.01); *F21V 17/02* (2013.01); *F21V 31/005* (2013.01);
(Continued)

(58) Field of Classification Search
CPC ..... F21V 14/06; F21V 5/048; F21V 14/045; F21W 2131/301
(Continued)

(56) References Cited

U.S. PATENT DOCUMENTS

2013/0329408 A1* 12/2013 Windom ..... F21V 5/04 362/187
2014/0240969 A1* 8/2014 Chen ..... F21L 4/005 362/187
2017/0038034 A1* 2/2017 Hierzer ..... F21V 14/06

FOREIGN PATENT DOCUMENTS

CN 203784759 U * 8/2014

OTHER PUBLICATIONS

Ma, Focus-adjustable LED lamp for museum, Aug. 20, 2014, Patent Pub CN 203784759 U; Google Patents, https://patents.google.com/patent/CN203784759U/en.*

* cited by examiner

*Primary Examiner* — Anh T Mai
*Assistant Examiner* — Michael Chiang
(74) *Attorney, Agent, or Firm* — Wang Law Firm, Inc.

(57) ABSTRACT

A zoom LED lamp comprises a chip receiving cylinder, a chip fixing column, a lens receiving cylinder, and a fixing cylinder. The chip receiving cylinder comprises a radial positioning ring, a receiving groove, and an elastic sealing ring. The chip fixing column comprises a column body and at least two ears. The two ears are fixed in the chip receiving cylinder. The lens receiving cylinder comprises a lens cylinder and two openings respectively inserted into the two ears. The zoom LED lamp not only fixes the position of the lens cylinder in the radial direction, but also allows the elastic sealing ring to fix the position of the lens cylinder in the axial direction of the chip receiving cylinder when no external force is applied. In addition, the sliding path of the lens cylinder in the axial direction of the chip receiving cylinder can also be limited, so that the irradiation range of the zoom LED lamp can be regulated.

10 Claims, 2 Drawing Sheets

(51) Int. Cl.

| | |
|---|---|
| ***F21V 17/02*** | (2006.01) |
| ***F21V 31/00*** | (2006.01) |
| *F21V 21/30* | (2006.01) |
| *F21W 131/301* | (2006.01) |
| *F21Y 115/10* | (2016.01) |

(52) U.S. Cl.
CPC ..... *F21V 21/30* (2013.01); *F21V 31/00* (2013.01); *F21W 2131/301* (2013.01); *F21Y 2115/10* (2016.08)

(58) Field of Classification Search
USPC ..... 362/187
See application file for complete search history.

ZOOM LED LAMP WITH SLIDABLE LENS

CROSS-REFERENCE TO A RELATED APPLICATION

This application claims priority to a Chinese Patent Application No. CN 201710897312.0, filed on Sep. 28, 2017.

FIELD OF THE TECHNOLOGY

The present invention relates to the field of lamps, with particular emphasis on a zoom LED lamp.

BACKGROUND

In ordinary daily life, all kinds of lighting apparatus can be seen everywhere, such as fluorescent lamps, street lamps, table lamps, artistic lamps and so on. In the above-described lighting apparatus, the tungsten bulb is traditionally used as a light-emitting light source. In recent years, due to the ever-changing technology, light-emitting diode (LED) has been used as a light source. Moreover, in addition to lighting apparatus, for the general traffic signs, billboards, headlights etc., light-emitting diode has also been used as a light source. The light-emitting diode as a light source has the advantages of energy-saving and greater brightness. Therefore, it has been gradually common.

With the popularity of LED lamps, LED lamps are used in more and more occasions. In some key areas of lighting, LED lighting range often needs to be adjusted according to actual needs. In the prior art, different lamps lighting ranges are often replaced according to these actual needs. This undoubtedly increases the cost of manufacturing enterprises and installation companies, and also easily leads to confusion in maintenance and replacement.

SUMMARY OF THE INVENTION

Therefore, it is necessary to provide a zoom LED lamp that can adjust the illumination range according to actual needs so as to solve the above problems.

A zoom LED lamp comprising: a chip receiving cylinder, a chip fixing column fixed in the chip receiving cylinder, a lens receiving cylinder slidably arranged in the chip receiving cylinder, and a fixing cylinder disposed on the lens receiving cylinder; the chip receiving cylinder comprising a radial positioning ring, a receiving groove disposed on the radial positioning ring, and an elastic sealing ring received in the receiving groove, the minimum inner diameter of the elastic sealing ring being smaller than the minimum inner diameter of the radial positioning ring; the chip fixing column comprising a cylinder spaced apart from an inner side wall of the chip receiving cylinder and at least two ears extending from the column body; the two ears being fixed in the chip receiving cylinder, the maximum outer diameter of the lens receiving cylinder being equivalent to the minimum inner diameter of the radial positioning ring and sleeved on the radial positioning ring; the lens receiving cylinder comprising a lens cylinder and two openings opened on the lens cylinder and respectively receiving the two ears; the fixing cylinder disposed on one opening side of the lens cylinder, the elastic sealing ring abutting on the lens receiving cylinder such that the lens receiving cylinder is fixed in relative positions of the chip receiving cylinder when not subjected to external force.

Further, an axial height of the radial positioning ring along the chip receiving cylinder is less than half of an axial length of the chip receiving cylinder.

Further, the lens cylinder is provided between the chip receiving cylinder and the chip fixing column.

Further, the zoom LED lamp further comprises a lens disposed in the lens receiving cylinder, and the lens cylinder comprises an inner sleeve, and a lampshade disposed in the inner sleeve, the lens is sandwiched between the inner sleeve and the lampshade, and the two openings are disposed on the other axial direction side of the inner sleeve with respect to the lampshade.

Further, the zoom LED lamp further comprises a lens disposed in the lens receiving cylinder, the lens receiving cylinder comprises an inner sleeve and an lampshade integrally formed with the inner sleeve, and an inner ring latching the lens. And a step is provided on the inner sleeve, and the lens is sandwiched between the step and the inner ring.

Further, the zoom LED lamp further comprises a mounting cylinder, the outer sidewall of the chip receiving cylinder is spherical, and one end of the mounting cylinder has a limiting ring; the diameter of the limiting ring is smaller than the maximum outer diameter of the chip receiving cylinder, an elastic ring is arranged on the inner side wall of the mounting cylinder, the chip receiving cylinder is clamped at one end of the elastic ring and one open end of the mounting cylinder.

Further, a diameter of the elastic ring is smaller than a maximum outer diameter of the chip receiving cylinder.

Further, the zoom LED lamp further comprises a block ring disposed on the mounting cylinder, the chip receiving cylinder is sandwiched between the limiting ring and the block ring.

Further, the zoom LED lamp further comprises a lens disposed in the lens receiving cylinder, the lens receiving cylinder, the fixing cylinder and the lens moves along the optical axis of the lens.

Further, the fixing cylinder and the lens receiving cylinder are screwed together.

Compared with the prior art, the zoom LED lamp provided by the present invention can not only fix the lens receiving cylinder by virtue of the chip receiving cylinder and the radial positioning ring and the elastic sealing ring provided on the chip receiving cylinder in the radial direction, and at the same time, the elastic sealing ring can fix the position of the lens cylinder in the axial direction of the chip receiving cylinder when no external force is applied. In addition, since the chip fixing column has the two ears, the sliding movement of the lens receiving cylinder in the axial direction of the chip holding barrel can be limited, so that the irradiation range of the zoom LED lamp can be regulated.

DETAILED DESCRIPTION OF THE DRAWINGS

The drawings described herein are intended to promote a further understanding of the present invention, as follows.

DESCRIPTION OF THE PREFERRED EMBODIMENTS

The present application is illustrated by way of the following detailed description based on of the accompanying drawings. It should be noted that illustration to the embodiment in this application is not intended to limit the invention.

Figure 1:
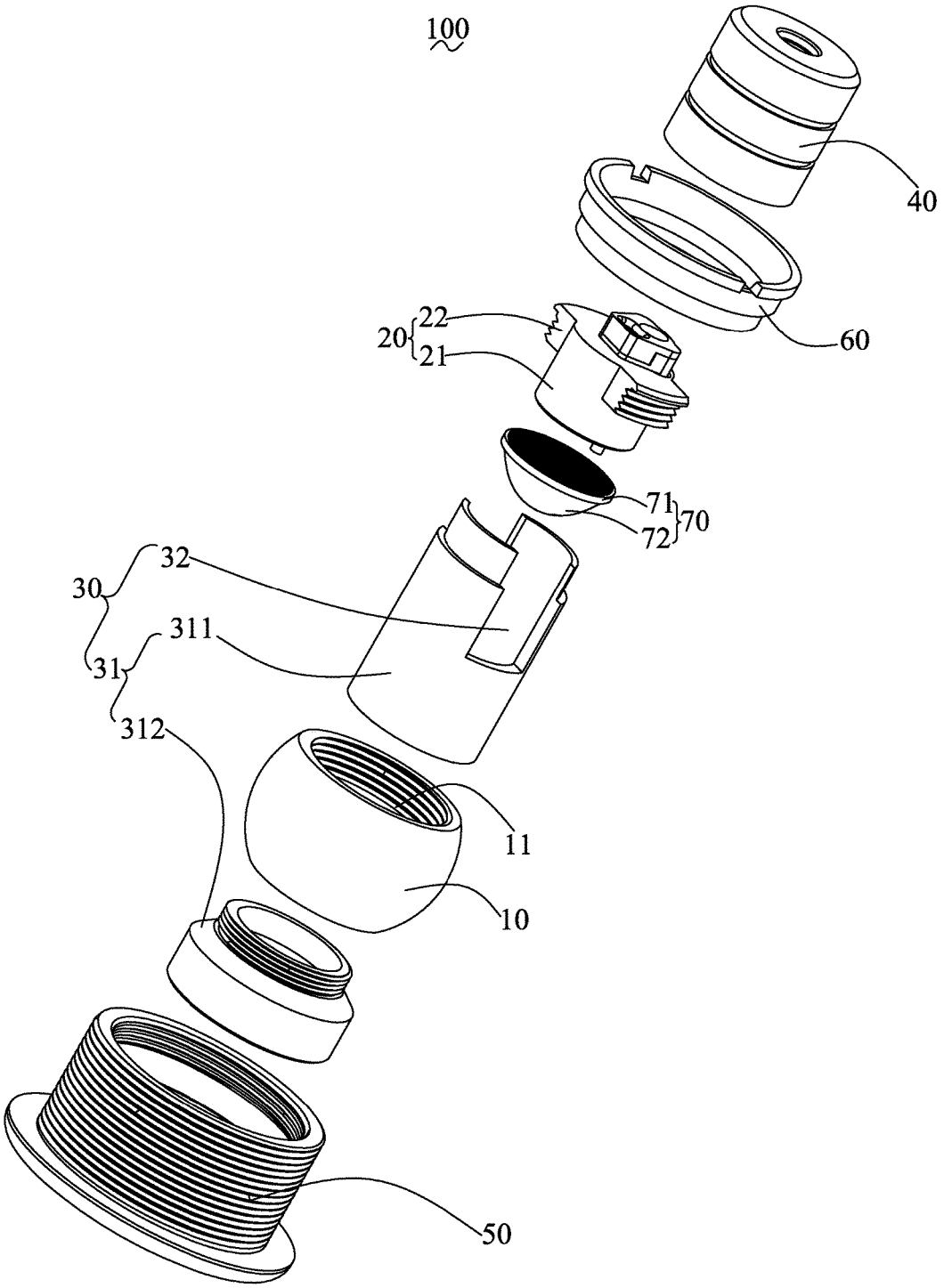
FIG. 1 is an exploded structural diagram of a zoom LED lamp according to the present invention.
Figure 2:
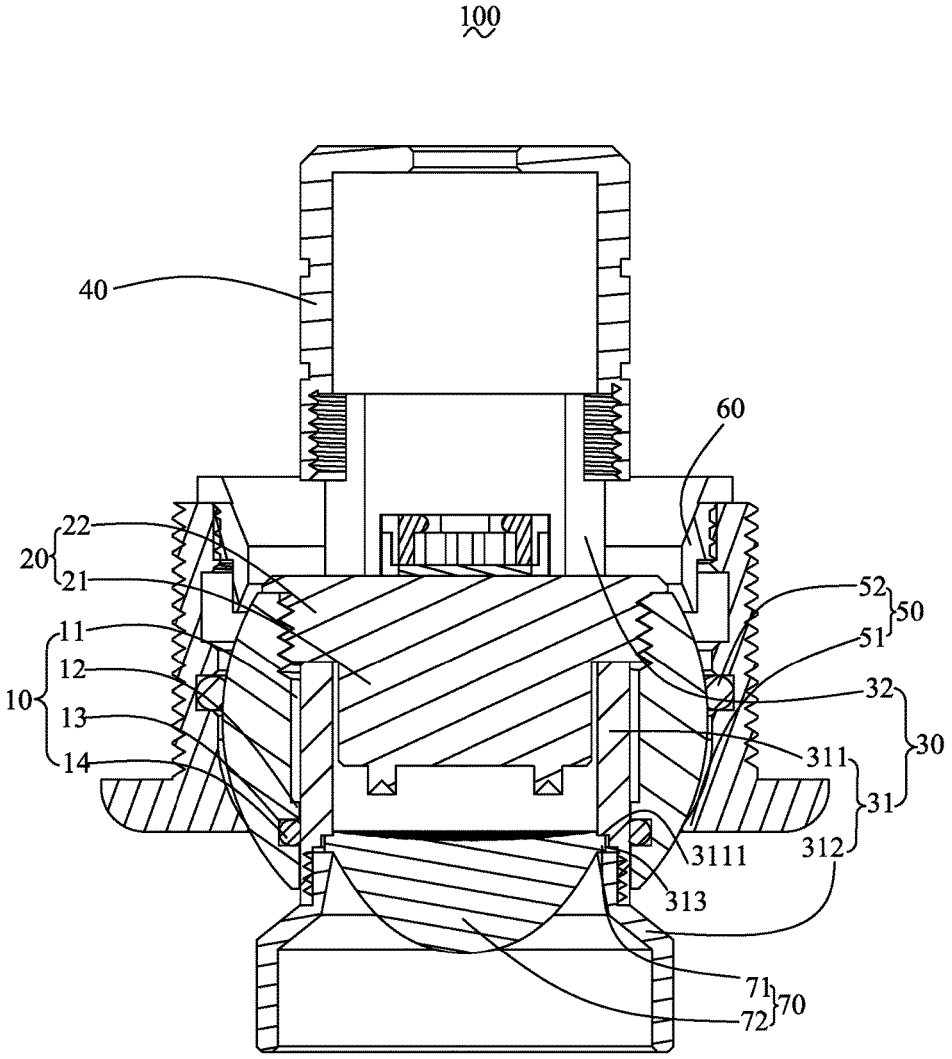
FIG. 2 is a cross-sectional structural diagram of the zoom LED lamp according to FIG. 1.

Please referring to FIG. 1 and FIG. 2, FIG. 1 is an exploded structural diagram of a zoom LED lamp 100 according to the present invention. The zoom LED lamp 100 comprises a chip receiving cylinder 10, a chip fixing column 20 fixed in the chip receiving cylinder 10, a lens receiving cylinder 30 slidably arranged in the chip receiving cylinder 10, and a fixing cylinder 40 disposed on the lens receiving cylinder 30, a mounting barrel 50 for receiving the chip receiving cylinder 10, a block ring 60 disposed on the mounting cylinder 50, a lens 70 disposed in the lens receiving cylinder 30. It is conceivable that the zoom LED lamp 100 further comprises other functional modules such as a mounting assembly, an electrical plug-in assembly, a light-emitting module disposed on the chip mounting post 20, and the like. The light-emitting module comprises a circuit Board, and at least one LED chip disposed on the circuit board. However, all of the above functional modules should be prior art and be well-known to those skilled in the art.

The chip receiving cylinder 10 comprises a cylinder body 11, a radial positioning ring 12 disposed on the inner side wall of the cylinder body 11, a receiving groove 13 disposed on the radial positioning ring 12, and an elastic sealing ring 14 received in the receiving groove 13. The radial positioning ring 12 is set along the axial direction of the chip receiving cylinder 10, that is, the axial height of the radial positioning ring 12 is smaller than the axial length of the chip receiving cylinder 10, and the axial height of the radial positioning ring 12 is half of the axial length of the cylinder body 11. And at the same time, since the maximum outer diameter of the lens receiving cylinder 30 is equivalent to the minimum inner diameter of the radial positioning ring 12 and sleeved on the radial positioning ring 12, the radial positioning ring 12 can make sure that the lens receiving cylinder 30 can slide only in the axial direction of the cylinder body 11 while a gap between the lens receiving cylinder 30 and the cylinder body 11 can be formed. The gap can reduce the frictional area between the chip receiving cylinder 10 and the lens receiving cylinder 30, so that abrasion can be reduced. The receiving groove 13 is formed in an inner wall of the radial positioning ring 12 for receiving the elastic sealing ring 14. Therefore, the receiving groove 13 should have the same size as the elastic sealing ring 14 so as to fix the position of the elastic sealing ring 14. The elastic sealing ring 14 may be made of an elastic material such as silicone rubber. The maximum diameter of the cross-section of the elastic sealing ring 14 should be greater than the maximum diameter of the cross-section of the receiving groove 13 so that the elastic sealing ring 14 abuts against the lens receiving cylinder 30 and the relative position of the lens receiving cylinder 30 to the chip receiving cylinder 10 is fixed when no external force is applied thereto. When the lens receiving cylinder 30 is pushed and pulled by an external force in the axial direction of the cylinder body 11, the lens receiving cylinder 30 can move back and forth or up and down along the axial direction of the cylinder body 11. The outer side wall of the chip receiving cylinder 10 may be a spherical shape so as to be rotatable in the mounting barrel 50 and then can be irradiated with different directions. The specific structure of the chip receiving cylinder 10 will be described in detail below.

The chip fixing column 20 is fixed in the chip receiving cylinder 10 and comprises a column body 21 spaced apart from the inner side wall of the chip receiving cylinder 10 and at least two ears 22 extending from the column body 21. The column body 21 is configured to dispose the light-emitting module. Specifically, the light-emitting module is disposed on the cross-section of the column body 21. The column body 21 is spaced apart from the inner sidewall of the cylinder body 11 so as to pass through the lens receiving cylinder 30 so that the lens receiving cylinder 30 can move back and forth or up and down in the gap between the column body 21 and the inner sidewall of the cylinder body 11 to achieve the purpose of zooming. The two ears 22 extend from the column body 21 and are fixed in the chip receiving cylinder 10. Specifically, the two ears 22 are screwed on the inner sidewall of the cylinder body 11. The two ears 22 are disposed at a distance from the radial positioning ring 12 to avoid interference with the sliding of the lens receiving cylinder 30.

The lens receiving cylinder 30 comprises a lens cylinder 31 and two openings 32 opened on the lens cylinder 31 and respectively inserted into the two ears. The lens cylinder 31 comprises an inner sleeve 311 and a lampshade 312 disposed on the inner sleeve 311. The two openings 32 are disposed on the inner sleeve 311 and disposed on the other side of the inner sleeve 311 with respect to the lampshade 312 in the axial direction. The inner sleeve 311 is disposed between the cylinder body 11 of the chip receiving cylinder 10 and the column body 21 of the chip fixing column 20 and is positioned by the radial positioning ring 12 and the elastic sealing ring 14. That is, the elastic sealing ring 14 abuts against the inner sleeve 311. The inner sleeve 311 may be integrally formed with the lampshade 312, or may be screwed together. In this embodiment, the inner sleeve 311 and the shade 312 are screwed together. When the inner sleeve 311 and the lampshade 312 are screwed together, the lens 70 can be sandwiched between the inner sleeve 311 and the lampshade 312, so that the assembly of the lens 70 can be completed. When the inner sleeve 311 and the lampshade 312 are integrally formed, an additional assembling mechanism needs to be designed to assemble the lens 70. For example, the inner sleeve 311 is provided with a step 313, and the lens receiving cylinder further comprises an inner ring 3111 latching the lens 70 so that the lens 70 is sandwiched between the step 313 and the inner ring 3111. The structure is relatively simple and should be conceivable to those skilled in the art.

The fixing cylinder 40 is disposed on an opening side of the lens cylinder 31 of the lens receiving cylinder 30 so that the two ears 22 of the chip fixing column 20 can be sandwiched between the lens cylinder 31 and the fixing cylinder 40 thus the distance by which the lens receiving cylinder 30 slides in the axial direction thereof can be defined. The fixing cylinder 40 and the lens receiving cylinder 30 may be fixed by any conventional technology, such as riveting and welding. In the present embodiment, the fixed barrel 40 is screwed into the inner sleeve 311 of the lens cylinder 30.

The mounting barrel 50 is used to receive the chip receiving cylinder 10, and is also used to mount the zoom LED lamp 100 on a cabinet such as a showcase. How to install the cabinet 50 onto the cabinet through at least the mounting cylinder 50 should be a technology known to those skilled in the art and will not be described in detail here. In order to allow the chip receiving cylinder 10 to rotate in the mounting barrel 50 to change the light exit direction, one end of the mounting barrel has a limiting ring 51. The diameter of the stop ring 51 is smaller than the maximum outer diameter of the chip receiving cylinder 10. An elastic ring 52 is further disposed on an inner sidewall of the mounting barrel 50. The chip receiving cylinder 10 is clamped between the elastic ring 52 and an opening of one end of the mounting barrel 50. Preferably, the inner wall of the mounting barrel 50 should also be spherical. The diameter of the elastic ring 52 is smaller than the maximum outer diameter of the chip receiving cylinder 10 so as to prevent the chip receiving cylinder 10 from slipping out of the elastic ring 52. It is conceivable that in order to be able to operate the lens cylinder 30, the length of the lens cylinder 30 and the fixing cylinder 40 in the axial direction thereof should be greater than the length of the mounting barrel 50.

The block ring 60 is disposed on the mounting cylinder 50. The chip receiving cylinder 10 is sandwiched between the limiting ring 51 and the block ring 60. The function of the block ring 60 is to ensure that the chip receiving cylinder 10 can't slide out of the mounting cylinder 50.

The lens 70 comprises a mounting portion 71 and a light distribution portion 72 connected to the mounting portion 71. The mounting portion 71 is sandwiched between the inner sleeve 311 and the shade 312 to fix the lens 70. The configuration of the light distributing portion 72 should be designed according to actual needs. In this embodiment, the light distributing portion 72 is a convex lens for collecting light. It is well known that each lens comprises an optical axis. In the present embodiment, the lens cylinder 30 and the fixed barrel 40 together with the lens 70 move along the optical axis of the lens 70.

Compared with the prior art, the zoom LED lamp provided by the present invention can not only fix the lens receiving cylinder 30 by virtue of the chip receiving cylinder 10 and the radial positioning ring 12 and the elastic sealing ring 14 provided on the chip receiving cylinder in the radial direction, and at the same time, the elastic sealing ring 14 can fix the position of the lens cylinder in the axial direction of the chip receiving cylinder 30 when no external force is applied. In addition, since the chip fixing column 20 has the two ears 22, the sliding movement of the lens receiving cylinder 10 in the axial direction of the chip holding barrel can be limited, so that the irradiation range of the zoom LED lamp can be regulated.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

The invention claimed is:

1. A zoom LED lamp with slidable lens comprising: a chip receiving cylinder, a chip fixing column fixed in the chip receiving cylinder, a lens receiving cylinder slidably arranged in the chip receiving cylinder, and a fixing cylinder disposed on the lens receiving cylinder;

the chip receiving cylinder comprising a radial positioning ring, a receiving groove disposed on the radial positioning ring, and an elastic sealing ring received in the receiving groove, the minimum inner diameter of the elastic sealing ring being smaller than the minimum inner diameter of the radial positioning ring;

the chip fixing column comprising a column body spaced apart from an inner side wall of the chip receiving cylinder and at least two ears extending from the column body; the two ears being fixed in the chip receiving cylinder, the maximum outer diameter of the lens receiving cylinder being equivalent to the minimum inner diameter of the radial positioning ring and sleeved on the radial positioning ring;

the lens receiving cylinder comprising a lens cylinder and two openings opened on the lens cylinder and respectively receiving the two ears;

the fixing cylinder disposed on one opening side of the lens cylinder, the elastic sealing ring abutting on the lens receiving cylinder such that the lens receiving cylinder is fixed in relative positions of the chip receiving cylinder when not subjected to external force.

2. The zoom LED lamp with slidable lens as claimed in claim 1, wherein an axial height of the radial positioning ring along the chip receiving cylinder is less than half of an axial length of the chip receiving cylinder.

3. The zoom LED lamp with slidable lens as claimed in claim 1, wherein the lens cylinder is provided between the chip receiving cylinder and the column body of the chip fixing column.

4. The zoom LED lamp with slidable lens as claimed in claim 1, wherein the zoom LED lamp further comprises a lens disposed in the lens receiving cylinder, and the lens cylinder comprises an inner sleeve, and a lampshade disposed in the inner sleeve, the lens is sandwiched between the inner sleeve and the lampshade, and the two openings are disposed on the other axial direction side of the inner sleeve with respect to the lampshade.

5. The zoom LED lamp with slidable lens as claimed in claim 1, wherein the zoom LED lamp further comprises a lens disposed in the lens receiving cylinder, the lens receiving cylinder comprises an inner sleeve and a lampshade integrally formed with the inner sleeve, and an inner ring latching the lens, and a step is provided on the inner sleeve, and the lens is sandwiched between the step and the inner ring.

6. The zoom LED lamp with slidable lens as claimed in claim 1, wherein the zoom LED lamp further comprises a mounting cylinder, the outer sidewall of the chip receiving cylinder is spherical, and one end of the mounting cylinder has a limiting ring; the diameter of the limiting ring is smaller than the maximum outer diameter of the chip receiving cylinder, an elastic ring is arranged on the inner side wall of the mounting cylinder, the chip receiving cylinder is clamped at one end of the elastic ring and one open end of the mounting cylinder.

7. The zoom LED lamp with slidable lens as claimed in claim 6, wherein a diameter of the elastic ring is smaller than a maximum outer diameter of the chip receiving cylinder.

8. The zoom LED lamp with slidable lens as claimed in claim 6, wherein the zoom LED lamp further comprises a block ring disposed on the mounting cylinder, the chip receiving cylinder is sandwiched between the limiting ring and the block ring.

9. The zoom LED lamp with slidable lens as claimed in claim 1, wherein the zoom LED lamp further comprises a lens disposed in the lens receiving cylinder, the lens receiving cylinder, the fixing cylinder and the lens moves along the optical axis of the lens.

10. The zoom LED lamp with slidable lens as claimed in claim 1, wherein the fixing cylinder and the lens receiving cylinder are screwed together.

* * * * *